US007793676B2

(12) United States Patent
Albrecht et al.

(10) Patent No.: US 7,793,676 B2
(45) Date of Patent: Sep. 14, 2010

(54) METHOD FOR SUPPLYING A PAINT APPLICATION DEVICE WITH PAINT

(75) Inventors: Markus Albrecht, Abstatt (DE); Aydin Ucan, Ludwigsburg (DE)

(73) Assignee: Eisenmann Lacktechnik GmbH & Co. KG, Boeblingen (DE)

( * ) Notice: Subject to any disclaimer, the term of this patent is extended or adjusted under 35 U.S.C. 154(b) by 676 days.

(21) Appl. No.: 10/520,302

(22) PCT Filed: Jun. 18, 2003

(86) PCT No.: PCT/EP03/06400

§ 371 (c)(1),
(2), (4) Date: Oct. 7, 2005

(87) PCT Pub. No.: WO2004/009247

PCT Pub. Date: Jan. 29, 2004

(65) Prior Publication Data

US 2006/0102650 A1 May 18, 2006

(30) Foreign Application Priority Data

Jul. 20, 2002 (DE) ..... 102 33 006

(51) Int. Cl.
*B08B 3/04* (2006.01)
*B05C 11/10* (2006.01)
*B65B 3/12* (2006.01)

(52) U.S. Cl. ..... 137/15.05; 118/684; 134/22.12; 141/91

(58) Field of Classification Search ..... 137/15.05, 137/15.04; 134/22.12, 40; 118/684; 222/386; 141/1, 91, 100
See application file for complete search history.

(56) References Cited

U.S. PATENT DOCUMENTS

| | | | | |
|---|---|---|---|---|
| 2,784,350 | A * | 3/1957 | Sedlacsik | 239/704 |
| 4,962,724 | A * | 10/1990 | Prus et al. | 118/688 |
| 5,289,947 | A * | 3/1994 | Akeel et al. | 222/108 |
| 5,855,062 | A * | 1/1999 | Kendall, Jr. | 29/828 |
| 5,882,428 | A * | 3/1999 | Gawne | 134/8 |
| 6,589,348 | B2 * | 7/2003 | Ott | 118/684 |
| 2002/0064601 | A1 | 5/2002 | Ott | |
| 2005/0173018 | A1 * | 8/2005 | Herre et al. | 141/91 |

FOREIGN PATENT DOCUMENTS

DE 690 03 621 T2 5/1994

(Continued)

*Primary Examiner*—John Rivell
*Assistant Examiner*—Atif H Chaudry
(74) *Attorney, Agent, or Firm*—Factor & Lake, Ltd.

(57) ABSTRACT

The invention relates to a method for supplying a paint application device with paint, whereby a determined amount of paint is transported between two scrapers through a scraper line, from a first scraper station which can be connected to a paint supply source, to a second scraper station which can be connected to the paint application device. Said scraper line is cleaned on the return path from the second scraper station to the first scraper station, by a cleaning product which is also transported between the two scrapers. In this way, the scraper line can be cleaned in a reliable manner, with a simple embodiment of the scraper, thus rendering the inventive method especially useful when a color change is carried out.

16 Claims, 2 Drawing Sheets

FOREIGN PATENT DOCUMENTS

| | | | |
|---|---|---|---|
| DE | 197 42 588 | A1 | 4/1999 |
| DE | 198 30 029 | A1 | 1/2002 |
| EP | 1172152 | A1 * | 6/2001 |
| EP | 1 172 152 | A1 | 1/2002 |
| EP | 1 208 915 | A2 | 5/2002 |

* cited by examiner

METHOD FOR SUPPLYING A PAINT APPLICATION DEVICE WITH PAINT

The invention relates to a method for supplying a paint application device with paint, in which a) a given paint volume in each case is conveyed between two pigs through a pig line from a first pig station connectable to the paint supply source to a second pig station connectable to the paint application device;

b) the pig line is cleaned on the return path of the pigs from the second to the first pig station by means of a given quantity of cleaning agent that is conveyed by at least one pig;

c) the pigs are conducted through the pig line by a pressurised pushing medium.

A method of the above-mentioned type is known from EP 1 172 152 A1. It is especially suitable for use wherever a frequent change of the type of paint processed by the paint application device, e.g. a change of the paint colour, is to be expected. The quantity of paint required for a painting process is pushed through the pig line as a column of liquid well delimited at its leading and trailing ends. In this way, firstly, the internal cylindrical surface of the pig line is contaminated only slightly or not at all by the paint being transported; secondly, the risk that contaminants will be introduced into the volume of paint transported between the pigs is comparatively low. However, it is necessary, at least at given time intervals and especially when a colour change is made, to clean the internal cylindrical surface of the pig line with a cleaning agent.

With the method known from EP 1 172 152 A1 a liquid pushing medium retained in a closed line circuit is used, which pushing medium is contaminated in the course of time and therefore must be exchanged at given time intervals. The cleaning agent used for cleaning the internal cylindrical surface of the pig line is transported inside one or both pigs, which for this purpose are configured as "double pigs" having an internal cavity. However, the relatively small quantity of cleaning agent that can be used with this method is not always reliably sufficient for completely cleaning the pig line. Moreover, the construction of the "double pigs" used in this case is relatively complicated.

Described in DE 198 30 029 A1 is a method for supplying a paint application device in which various paints to be applied one after another are introduced successively into the same paint supply line, the individual paint liquid columns being separated from one another by pigs. In addition, a column consisting of cleaning liquid can be added between two successive columns of paint liquid. With this known method the pigs do not move back and forth between two stations, but are returned via a separate line. Again, with this known method the cleaning of the lines through which the paint moves is not always sufficient, in particular when a colour change is made.

It is the object of the present invention so to configure a method of the above-mentioned type that good cleaning of the pig lines is possible using apparatus of the lowest possible cost and complexity.

This object is achieved according to the invention in that:

d) on its return from the second pig station to the first pig station the cleaning agent is transported between the two pigs.

According to the invention, therefore, the "tandem" of two pigs is used in a similar way on its return from the second to the first pig station as on the outward path: a given volume of liquid is transported between the two pigs. Whereas on the outward path this liquid is paint, on the return path of the pigs from the second to the first pig station the space located between them is used for transporting cleaning liquid. In this case a comparatively large volume is now available for the cleaning liquid, so that a good cleaning effect can be reliably expected. With the present invention the pigs may be of very simple, conventional construction and also do not need to be especially long.

Compressed air is expediently used as the pushing medium for the pigs. Compressed air introduces practically no contaminants into the system and can be discharged into the atmosphere, so that the use of a closed pushing medium system, as in EP 1 172 152 A1, is not required.

A liquid solvent is expediently used as the cleaning agent.

If compressed air is used as the pushing medium, the velocity of the pigs can be simply adjusted by appropriately throttling the expulsion of air from the flow paths preceding the pigs. The greater the throttling effect, the slower the movement of the pigs.

It is especially preferred, when introducing the paint into the space between the two pigs in the first pig station, if the pressurised paint is used as the pushing medium for the leading pig.

In principle, the distance travelled by the leading pig could be used as a measure for the quantity of paint introduced into the space between the two pigs, and the feeding of paint into this space could therefore be ended when the leading pig has travelled a given distance. More accurate, however, is the embodiment of the invention in which the quantity of paint used as the pushing medium is measured, and the introduction of paint into the space between the two pigs is ended when the measured quantity of paint has been introduced, the trailing pig, together with the paint volume and the leading pig, then being moved by the pushing medium. The measuring of the paint introduced in the space between the pigs may be carried out with high precision outside the pig station in the paint supply line.

It is also advantageous, when introducing the cleaning agent into the space between the two pigs in the second pig station, if the pressurised cleaning agent is used as the pushing medium.

Because the precise quantity of cleaning agent which is transported by the two pigs on the return path to the first pig station is less critical, an embodiment of the invention is to be recommended in which the supply of cleaning agent to the space between the two pigs in the second pig station is ended when the leading pig has travelled a given distance, the trailing pig, together with the volume of cleaning agent and the leading pig, then being moved by the pushing medium. In the case of cleaning agents, therefore, the accuracy of the volumetric measurement effected by measuring the distance travelled by the leading pig is entirely sufficient.

The pig stations, too, should be flushed with cleaning agent at least when making a colour change.

In this case it is especially recommended that the pig stations be flushed alternately with cleaning agent and compressed air. An especially good cleaning effect is achieved by alternating, pulse-like charging with liquid cleaning agent and compressed air.

In cases when the application of the paint to the tool to be painted is assisted by electrostatic forces, the paint application device includes an electrode that can be placed under high voltage. In the case of "internal charging", in which the paint to be applied comes into contact with the high-voltage electrode inside the paint application device, the problem arises of galvanically separating the paint application device and the neighbouring system components from the paint supply source, which generally is at ground potential. In this connection it is recommended that the high voltage be applied to the paint application device only when the pigs are located at a given minimum distance outside the pig stations in the pig line. The minimum distance is so selected that the required galvanic separation is ensured in the corresponding section of pig line without the risk of an electrical short-circuit.

In the case of paint application devices operating with high voltage it is also advantageous if the cleaning agent is fed to the components which can be placed under high voltage via a line, and is conducted away from these components via a line, the lengths of which lines are artificially increased through coiling in a particular area. The complex and costly pig method of galvanic separation is not, therefore, used for these lines. Instead, a sufficiently high electrical resistance between the system components under high voltage and the system components at ground potential is ensured by an appropriate length of the lines, which length normally considerably exceeds the length of the lines required for geometrical reasons.

An embodiment of the invention is elucidated in more detail below with reference to the drawings, in which.

Figure 1:
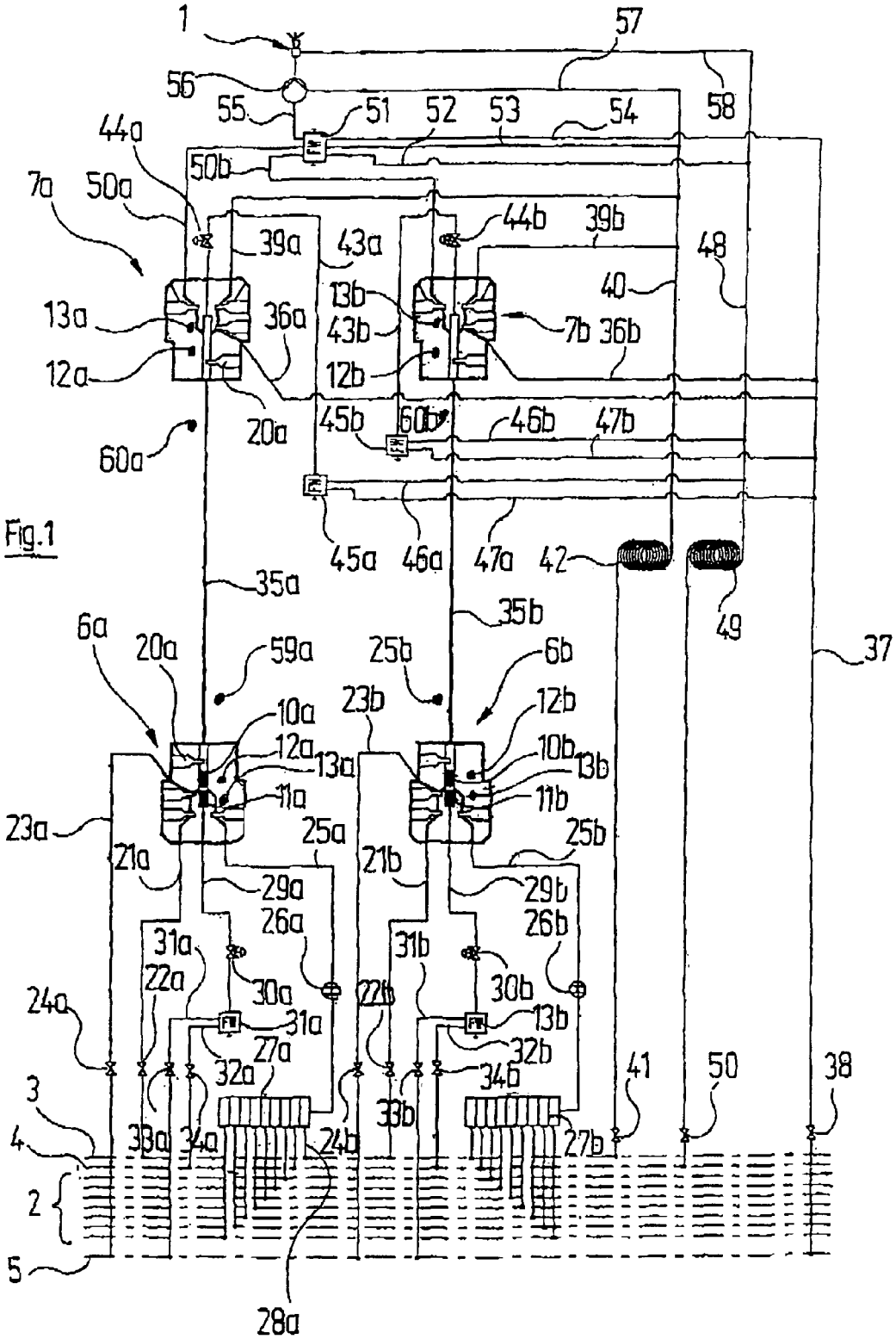
FIG. 1 shows schematically a paint supply system having two parallel branches in the paint supply to the spray nozzle.

The paint supply system represented in the drawings, in particular in FIG. 1, is used to supply a spray nozzle 1 operating with internal charging and shown at the top edge of FIG. 1 selectively with one of the paints of different colours circulating in the paint supply lines 2 shown at the bottom edge of FIG. 1. In the system shown there are seven such paint supply lines 2, so that seven paint colours can be processed. In addition, a solvent supply line 3, a discharge line 4 and a compressed air line 5 are disposed parallel to the paint supply lines 2.

The supply of paint from the paint supply lines 2 to the spray nozzle 1 is effected via two parallel system branches. The suffix a is appended to the reference symbols of the components belonging to the left-hand system branch in FIG. 1, while the suffix b is appended to the reference symbols of the components belonging to the right-hand system branch in FIG. 1. Because both branches are of identical construction, only the system branch located on the left in FIG. 1 will be described in detail below.

Figure 2:
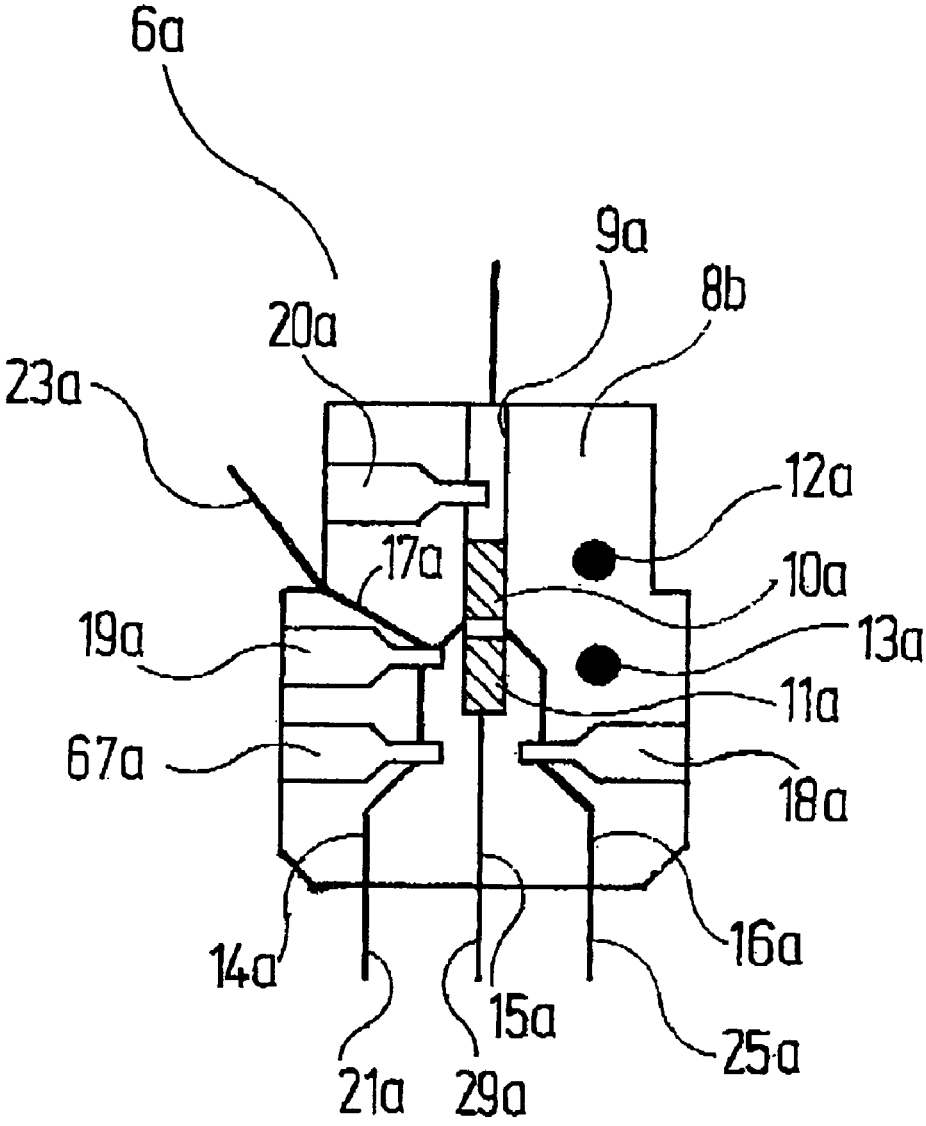
FIG. 2 shows on a larger scale a pig station as used in the paint supply system of FIG. 1.

This system branch comprises as its most important components a first pig station 6*a* located in the vicinity of the paint supply lines 2, and a second pig station 7*a* located in the vicinity of the spray nozzle 1. The construction of all the pig stations 6*a*, 6*b*, 7*a*, 7*b* in the paint supply system is identical, so that it is sufficient to elucidate in detail the construction of pig station 6*a* with reference to FIG. 2:

The pig station 6*a* comprises a housing 8*a* in which is formed a movement passage 9*a* for two pigs 10*a*, 11*a* arranged one behind the other. In FIGS. 1 and 2 the two pigs 10*a* and 11*a* are shown in their respective parking positions inside the pig station 6*a*. Located in proximity to these parking positions are detectors 12*a*, 13*a* which can respectively detect the presence of pig 10*a* and pig 11*a* in their parking positions.

A total of four passages 14*a*, 15*a*, 16*a*, 17*a*, via which different media can be introduced at different sites in the movement passage 9*a* in a manner still to be described, lead through the housing 8*a* to the movement passage 9*a*. The middle passage 15*a* in FIG. 2 leads to the end of the movement passage 9*a*, so that the medium conducted to this site can act upon the end face of the pig 11*a* located at the bottom in FIG. 2. The other passages 14*a*, 16*a*, 17*a*, by contrast, open from opposite sides into the movement passage 9*a* at a site located between the two pigs 10*a* and 11*a*, so that the space located between these two pigs 10*a* and 11*a* can be reached from here. Located in each of these three passages 14*a*, 16*a*, 17*a* is a respective stop valve 67*a*, 18*a*, 19*a*.

A stop 20*a* actuated by compressed air can be moved into the movement passage 9*a* of the pigs 10*a*, 11*a*. Only when the stop 20*a* is retracted can the pigs 10*a*, 11*a* be moved out of or into the pig station 6*a*.

As shown in FIG. 1, the bottom, left-hand passage 14*a* of the pig station 6*a* in FIG. 2 is connected to the solvent supply line 3 via a line 21*a* in which a stop valve 22*a* is located. The passage 17 located at the top left in FIG. 2 is connected to the compressed air line 5 via a line 23*a* in which a stop valve 24*a* is located. The passage 16*a* located at the bottom right in FIG. 2 is connected to a colour-change unit 27*a* via a line 25*a* in which a volumeter unit 26*a* is located. The colour-change unit 27*a* is in turn in communication, via a total of nine branch lines 28*a*, with the paint supply lines 2, with the solvent supply line 3 and with the discharge line 4. The colour-change unit 27*a* is able to establish a connection selectively between the line 25*a* and one of the lines 2, 3, 4.

Finally, the passage 15*a* located in the lower middle portion of the housing 8*a* of the pig station 6*a* is connected to a change-over valve 31*a* via a line 29*a* in which a controllable throttle valve 30*a* is located. The change-over valve 31*a* is able to connect the line 29*a* selectively to a first branch line 32*a* or a second branch line 33*a*, or to interrupt both connections. The left-hand branch line 31*a* in FIG. 1 leads via a stop valve 33*a* to the compressed air supply line 5, while the right-hand branch line 32*a* in FIG. 1 leads via a stop valve 34*a* to the discharge line 4.

The mouth of the movement passage 9*a* of the pig station 6*a* is connected to the mouth of the movement passage 9*a* of the oppositely arranged pig station 7*a* located in proximity to the spray nozzle 1 via a pig line 35*a* represented only schematically in FIG. 1. The pig line 35*a* may be a flexible hose the internal diameter of which is adapted in known fashion to the external diameter of the pigs 10*a*, 11*a* in such a way that the cylindrical surfaces of the pigs 10*a*, 11*a* fit in a fluid-tight manner against the internal cylindrical surface of the pig line 35*a* as they move through same.

The different passages 9*a*, 14*a*, 15*a*, 16*a* and 17*a* of the pig station 7*a* close to the spray nozzle are integrated in the system as follows:

The passage 17*a* is connected via a line 36*a* to a compressed air distribution line 37 which in turn is connected via a stop valve 38 to the compressed air line 5.

The passage 14*a* of the pig station 7*a* is connected via a line 39*a* to a solvent distribution line 40*a* which is connected via a stop valve 41 to the solvent supply line 3. The solvent distribution line 40 is wound to form a spiral 42 at one location. For reasons which will become clear below the overall length of the solvent distribution line 40 is thereby intended to be increased.

The passage 15*a* of the pig station 7*a* close to the spray nozzle is in turn connected to a change-over valve 45*a* via a line 43*a* in which a controllable throttle valve 44*a* is located. The change-over valve 45*a* is able to connect the line 43*a* selectively to one of two lines 46*a*, 47*a*, or to shut off the line 43*a*. The upper line 46*a* in FIG. 1 leads to a disposal collection line 48 which in turn is connected to the disposal line 4 via a spiral-wound portion 49 and a stop valve 50.

Finally, the passage 16*a* of the pig station 7*a* close to the spray nozzle is connected via a line 50*a* to a further change-over valve 51 to which the line 50*b* of the right-hand system branch in FIG. 1, corresponding to the line 50*a*, also leads.

The two system branches are thereby brought together at the change-over valve 51. The change-over valve 51 is able to connect each of the lines of 50*a*, 50*b* selectively to one of four lines 52, 53, 54, 55 or to shut off each of said lines 50*a*, 50*b*. The bottom line 52 in FIG. 1 leads to the disposal collection line 48, the line 53 located above it to the solvent distribution line 40 and the line 54 located above it again to the compressed air distribution line 37, while the line 55 extending substantially upwardly from the change-over valve 51 leads to a metering pump 56, the outlet of which is in turn connected to the spray nozzle 1. The metering pump 56 may in addition be supplied with solvent from the solvent distribution line 40 via a line 57. Finally, the spray nozzle 1 is connected to the disposal collection line 48 via a further line 58.

In the following description of the operation of the paint supply system, the right-hand system branch in FIG. 1 containing the components designated by b will initially not be considered. The way in which this system branch contributes to the overall operation will then be explained.

The situation represented in FIG. 1, in which the pigs 10*a*, 11*a* are located in the pig station 6*a* situated in the vicinity of the paint supply lines 2 will be taken as the starting point. Their presence in that location is verified by the detectors 12*a*, 13*a*. The stop 20*a* has been moved into the movement path of the pigs 10*a*, 11*a*, so that they cannot leave this pig station 6*a*. It should also be assumed that paint residues originating from an earlier painting process have been cleaned from all components in a manner which is not yet of interest here. For a new painting process a given quantity of the paint supplied to one of the paint supply lines 2 must now be delivered therefrom to the spray nozzle 1. To achieve this, the following procedure takes place:

First, by opening the corresponding stop valve in the colour-change unit 27*a*, a connection is established between the desired paint supply line 2 and the line 25*a* leading to the passage 16*a* of the pig station 6*a*. The stop 20*a* is retracted so that nothing now prevents the upper pig 10*a* from moving out of the pig station 6*a*. By opening the valve 18*a* in the pig station 6*a*, paint is now enabled to enter the space between the two pigs 10*a* and 11*a*, pushing the upper pig 10*a* in FIG. 1 out of the pig station 6*a*.

As this happens, the pig 10*a* displaces the air located ahead of it in the direction of movement in the pig line 35*a*. This air is fed via the movement passage 9*a* of the pig station 7*a* close to the spray nozzle, via the latter's passage 15*a* and the line 43*a* and, with appropriate positioning of the change-over valve 45*a*, via the line 46*a* and the discharge line 48, with the stop valve 50 open, to the discharge line 4. As this happens, the throttle valve 44*a* located downstream of the pig station 7*a* which is close to the spray nozzle, is so adjusted that the desired movement velocity of the pig 10*a* in the pig line 35*a* is produced.

The quantity of paint which is dispensed into the space between the moving pig 10*a* and the pig 11*a*, still located in its parking station in the pig station 6*a*, is monitored by the volumeter device 26*a*. Once the desired quantity is reached, both the corresponding stop valve in the colour-change unit 27*a* and the stop valve 18*a* in the pig station 6*a* are closed. The second pig 11*a* is now connected by its lower end face in the drawings, via the line 29*a* and the correspondingly set change-over valve 31*a*, to the compressed air line 5, after the stop valve 33*a* has been opened. The compressed air now also pushes the pig 11*a* out of the pig station 6*a* and—via the paint enclosed between the two pigs 10*a* and 11*a*—pushes forwards the pig 10*a* which has first left the pig station 6*a* and which up to this time has been propelled forwards by the paint.

A kind of "package" comprising the two pigs 10*a* and 11*a* and the paint volume enclosed therebetween is now formed and is moved forwards in the pig line 35*a* by the compressed air supplied via the line 29*a*. As this happens the throttle valve 30*a* in the line 29*a* is completely opened.

Located at a given distance from the outlet of the pig station 6*a* is a further detector 59 which can detect the passing-by of the two pigs 10*a*, 11*a*. The distance between the detector 59 and the pig station 6*a* is such that sufficient electrical insulation is achieved by the length of the corresponding section of the pig line 35*a*. The high voltage can now be applied to the internal electrode of the spray nozzle 1.

After passing through the pig line 35*a*, the leading pig 10*a* first enters the pig station 7*a* located close to the spray nozzle; as this happens, the stop 20*a* of the pig station 7*a* must, of course, be retracted. The reaching of its end and parking position by the pig 10*a* is detected by the detector 13*a* of the pig station 7*a*. The connection to the discharge line 48 is now interrupted in the change-over valve 45*a*. At the same time, by suitable switching of the change-over valve 51, the line 50*a* is connected to the metering pump 56 via the line 55. As the second pig 11*a*, pushing the paint volume before it, approaches the pig 10*a*, which has come to a stop in its parking position in the pig station 7*a*, the paint volume is displaced via the lines 50*a* and 55 to the metering pump 56. By appropriate actuation of the spray nozzle 1, the workpiece, for example, a vehicle body, can now be painted. The quantity of paint required in each case is set by the metering pump 56.

Once the painting process is completed, the high voltage is disconnected from the spray nozzle 1. The spray nozzle 1, the metering pump 56 and the line 55 between metering pump 56 and change-over valve 51 are flushed via the lines 53 and 57, with suitable setting of the change-over valve 51, and via the line 58, with the stop valves 41 and 50 open.

The residual paint still remaining between the pigs 11*a* and 10*a* in the pig station 7*a* is discharged by setting the change-over valve 51 so that the line 50*a* is now connected to the line 52 and therefore to the disposal line 4.

When the detector 12*a* of the pig station 7*a* located close to the spray nozzle detects that the second pig 11*a* has also reached its parking position inside the pig station 7*a*, the stop 20*a* of the pig station 7*a* is moved out, retaining the two pigs 10*a*, 11*a* in the pig station 7*a* located close to the spray nozzle.

The paint in the line 50*a*, which connects the pig station 7*a* to the change-over valve 51, is then discharged as follows: the valves 67*a* and 18*a* of the pig station 7*a* are opened and the change-over valve 51 is actuated in such a way that a connection is established between the line 50*a* and the discharge collection line 48. In this way solvent can flow through the space located between the two pigs 10*a*, 11*a* and the line 50*a* and clean the corresponding paths. By alternately opening the valves 19*a* and 67*a* the flow can be effected in a pulsed manner alternately with compressed air and with solvent. To conclude this cleaning process, any solvent located between the pig station 7*a* and the change-over valve 51 is expelled with compressed air.

The transporting of the two pigs 10*a*, 11*a* from the pig station 7*a* close to the spray nozzle back to the pig station 6*a* close to the paint supply lines 2 can now begin. As this happens, cleaning of the connecting path between the two pig stations 7*a*, 6*a*, in particular of the pig line 35*a*, takes place. Once again, a "package" is formed by the two pigs 10*a* and 11*a* and a volume of liquid enclosed thereby. However, this liquid is now a cleaning solvent. The individual processes are as follows:

The stop 20*a* of the pig station 7*a* is first retracted, clearing the way for the pigs 10*a*, 11*a*. The throttle valve 30*a* located downstream of the pig station 6*a* is now so adjusted that a certain resistance is produced for the air to be displaced, which is located in the pig line 35*a*, determining the movement velocity of the pigs 10*a*, 11*a* and of the volume of solvent enclosed therebetween.

First, by opening the valve 67*a* of the pig station 7*a* with the stop valve 41 open, solvent is introduced into the space between the two pigs 10*a* and 11*a* via the solvent distribution line 40 and the line 39*a*. The pig 11*a*, which is leading in this case, is thereby forced out of the pig station 7*a*. A further detector 60*a*, which responds to the passing-by of the two pigs 10*a*, 11*a*, is fitted at a given distance from the pig station 7*a* in proximity to the pig line 35*a*. If the detector 60*a* detects that the leading pig 11*a* has passed the corresponding point in the pig line 35*a*, the valve 67*a* is closed and the further supply of solvent to the space between the two pigs 10*a*, 10*b* is interrupted.

Compressed air is now supplied to the upper end face in FIG. 1 of the pig 10*a* still located in the pig station 7*a* via the change-over valve 45*a*, with the throttle valve 44*a* substantially open, and via the compressed air distribution line 37 and the lines 47*a* and 43*a*. This compressed air now pushes the entire "package" consisting of the two pigs 10*a*, 10*b* and the enclosed volume of solvent through the pig line 35*a*. Once the trailing pig 10*a* has passed the detector 60*a* a sufficient insulating distance between the "package" and the pig station 7*a* is present, so that the high voltage can again be applied to the spray nozzle 1.

Finally, the leading pig 11*a* in this cleaning process enters the pig station 6*a* close to the supply lines 2. If the detector 13*a* of the pig station 6*a* detects that the pig 11*a* has again reached its parking position represented in FIG. 1, the connection between the line 29*a* and the discharge line 4 is interrupted in the change-over valve 31*a*. Instead, the valve 18*a* of the pig station 6*a* and the corresponding valve inside the colour-change unit 27*a* are opened in such a way that the volume of solvent enclosed between the two pigs 10*a*, 11*a* can be forced into the discharge line 4 via the line 25*a* and the colour-change unit 27*a*. At the same time, the connecting line 25*a* and the volumeter unit 26*a* located therein are cleansed of paint.

If the detector 12*a* of the pig station 6*a* detects that the trailing pig 10*a* has also moved into its parking position in the pig station 6*a*, the stop 20*a* of the pig station 6*a* is moved in, so that both pigs 10*a*, 11*a* are retained in the pig station 6*a*. By opening the stop valve 22*a* in the line 21*a* and the valve 67*a* in the pig station 6*a*, the flushing process can be continued. As this happens, cleaning may again be carried out in a pulsed manner alternately with compressed air and with solvent by alternately opening the valves 67*a* and 19*a* of the pig station 6*a*. The final flushing process should again be carried out with compressed air.

The valves 18*a* of the pig station 6*a* and the stop valve of the colour-change unit 27*a* leading to the discharge line 4 are now closed. The left-hand system branch in FIG. 1 has now been completely cleaned and is ready for a new painting process using the same or another colour.

In principle, the paint supply system can be operated in the above-described manner with a single system branch. However, because of the return transportation of the two pigs 10*a*, 11*a* from the pig station 7*a* close to the spray nozzle to the pig station 6*a* close to the paint supply lines 2 and the associated cleaning process, undesired pauses in the painting process occur. For this reason, the second system branch which, as already mentioned, is constructed identically to the first system branch, is provided in the embodiment represented in the drawings. The two system branches are operated in a counter-cycling manner in the sense that one is always in the mode in which paint is transported in the direction of the spray nozzle 1 while the other is in the cleaning mode, in which the corresponding pig line 35*a* or 35*b* and the other components of the respective system branch are being freed of paint residues.

The spirals 42 and 49 in the distribution/collection lines 40 and 48 are intended to have the following effect: via the distribution/collection lines 40 and 48 there is a direct connection between the high-voltage electrode of the spray nozzle 1 and the solvent supply line 3 and the discharge line 4, which are connected to ground potential. To avoid an electrical short-circuit here the lengths of the distribution/collection lines 40, 48 are increased by the spirals 42 and 49 to such an extent that the electrical resistance formed thereby prevents the electrical short-circuit.

If no colour change is to take place between painting processes, the above-described processes can be carried out analogously, although cleaning processes are omitted.

The invention claimed is:

1. Method for supplying a paint application device with paint, the method comprising a given paint volume in each case is conveyed between two pigs through a pig line from a first pig station connectable to the paint supply source to a second pig station connectable to the paint application device, wherein the first and the second pig stations are capable of temporarily storing the two pigs, wherein a passage of the first pig station extends between a connection to the paint supply source and a connection to the pig line and a passage of the second pig station extends between a connection to the pig line and a connection to the paint application device, the pig line is cleaned on the return path of the pigs from the second to the first pig station by means of a given quantity of cleaning agent that is conveyed by at least one pig, and the pigs are conducted through the pig line by a pressurised pushing medium, and on return from the second pig station to the first pig station, the cleaning agent is transported between the two pigs, wherein the residual paint remaining between the two pigs when the painting process has been completed is disposed via the second pig station.

2. Method according to claim 1, wherein a liquid solvent is used as the cleaning agent.

3. Method according to claim 1, wherein compressed air is used as the pushing medium for the pigs.

4. Method according to claim 3, wherein velocity of the pigs is adjusted by appropriately throttling the expulsion of air from the flow paths located ahead of the pig.

5. Method according to claim 1, wherein as the paint is introduced into the space between the two pigs in the first pig station the pressurised paint is used as the pushing medium for the leading pig.

6. Method according to claim 5, wherein a quantity of paint used as the pushing medium is measured and the supply of paint to the space between the two pigs is ended when the desired quantity of paint has been introduced, and in that the trailing pig is ended when the desired quantity of paint has been introduced, and in that the trailing pig, together with the paint volume and the leading pig, is then moved by the pushing medium.

7. Method according to claim 1, wherein as the cleaning agent is introduced into the space between the two pigs in the second pig station, the pressurised cleaning agent is used as the pushing medium.

8. Method according to claim 7, wherein supply of cleaning agent to the space between the two pigs in the second pig station is ended when the leading pig has moved a given distance, and in that the trailing pig, together with the cleaning agent and the leading pig, is moved by the pushing medium.

9. Method according to claim 1, wherein the pig stations are flushed with cleaning agent at least when a colour change is made.

10. Method according to claim 9, wherein the pig stations are flushed alternately with cleaning agent and compressed air.

11. Method according to claim 1, wherein the paint application device includes an electrode that is connectable to a high voltage, and further wherein the high voltage is applied to the paint application device only when the pigs are located at a given minimum distance outside the pig stations in the pig line.

12. Method according to claim 11, wherein the cleaning agent is fed via a line to components that are connectable to a high voltage and is conducted away from these components via a line, wherein the lines are coiled in a particular area.

13. A method for supplying a paint application device with paint from a paint supply source, the method comprising the steps of:

providing a pair of pigs—a first pig and a second pig;

providing a first pig station and a second pig station, each pig station being capable of temporarily storing the pair of pigs;

injecting a paint between the pair of pigs;

conveying the paint between the pair of pigs from the first pig station toward the second pig station;

injecting a cleaning agent between the pair of pigs; and, conveying the cleaning agent between the pair of pigs from the second pig station toward the first pig station.

14. The method of claim 13 further comprising dispersing the paint from between the pair of pigs at the second pig station.

15. The method of claim 14 further comprising removing residual paint from between the pair of pigs via the second pig station.

16. The method of claim 13 further comprising removing residual paint from between the pair of pigs via the second pig station.

* * * * *